US006405458B1

(12) United States Patent
Fleshman

(10) Patent No.: US 6,405,458 B1
(45) Date of Patent: Jun. 18, 2002

(54) INFANT TRAINING SHOES AND METHOD OF USING SAME

(76) Inventor: Floyd W. Fleshman, 2054 Revere Rd., Cleveland Heights, OH (US) 44118

( * ) Notice: Subject to any disclaimer, the term of this patent is extended or adjusted under 35 U.S.C. 154(b) by 0 days.

(21) Appl. No.: 09/591,021

(22) Filed: Jun. 9, 2000

Related U.S. Application Data

(60) Provisional application No. 60/145,056, filed on Jul. 22, 1999.

(51) Int. Cl.[7] ..... A43B 13/00; A43B 3/30

(52) U.S. Cl. ..... 36/103; 36/112; 36/25 R; 434/397

(58) Field of Search ..... 36/103, 112, 25 R, 36/1, 116, 8.1, 122–125; 434/397

(56) References Cited

U.S. PATENT DOCUMENTS

| | | | | | |
|---|---|---|---|---|---|
| 509,535 | A | * | 11/1893 | Hilker | |
| 915,457 | A | * | 3/1909 | Marrotte | |
| 982,316 | A | * | 1/1911 | Vagtborg | |
| 1,494,452 | A | * | 5/1924 | Waldron et al. | |
| 1,870,751 | A | | 8/1932 | Reach | |
| 2,724,193 | A | | 11/1955 | McDermott | 36/1 |
| 2,761,223 | A | * | 9/1956 | Legeai | |
| 3,178,738 | A | * | 4/1965 | La Trell | |
| 3,463,163 | A | | 8/1969 | Matles | 128/583 |
| 3,463,164 | A | * | 8/1969 | Matles | |
| 3,728,803 | A | | 4/1973 | Hirasawa et al. | 36/2.5 E |
| 3,844,054 | A | | 10/1974 | Morris | 36/1 |
| 3,867,734 | A | * | 2/1975 | Courageux | |
| 4,372,058 | A | | 2/1983 | Stubblefield | 36/32 R |
| 4,468,870 | A | | 9/1984 | Sternberg | 36/130 |
| 4,559,724 | A | | 12/1985 | Norton | 36/129 |
| 4,738,262 | A | | 4/1988 | Zebrack | 128/581 |
| 4,790,083 | A | | 12/1988 | Dufour | 36/127 |
| 5,078,633 | A | * | 1/1992 | Tolbert, Jr. | |
| 5,181,873 | A | | 1/1993 | Tolbert | 441/65 |
| 5,265,354 | A | | 11/1993 | Aliano, Jr. | 36/127 |
| 5,266,062 | A | * | 11/1993 | Runckel | |
| 5,507,106 | A | | 4/1996 | Fox | 36/103 |
| 5,544,429 | A | | 8/1996 | Ellis, III | 36/25 R |
| 5,875,569 | A | | 3/1999 | Dupree | 36/103 |
| 6,086,440 | A | * | 7/2000 | Fechtner | |

* cited by examiner

*Primary Examiner*—Ted Kavanaugh
(74) *Attorney, Agent, or Firm*—Rankin, Hill, Porter & Clark LLP

(57) ABSTRACT

A shoe for use in training an infant to walk. The shoe includes an upper sized to receive an infant's foot and a sole that is attached to the upper. The sole extends a distance $D_1$ beyond a front side of the upper adjacent to the toes of the infant's foot, with the distance $D_1$ being from about 10% to about 30% of the length L of the infant's foot measured from heel to toe. Preferably, the sole also extends a distance $D_2$ beyond a rear side of the upper adjacent to the heel of the infant's foot, with the distance $D_2$ being from about 5% to about 15% of the length L. The present invention also provides a method of training an infant to walk. The method according to the present invention includes fitting a shoe according to the invention on each foot of the infant, encouraging the infant to walk while wearing the shoes, and removing a portion of the sole so as to proportionally decrease the extent to which the sole extends beyond the upper as the infant learns to walk.

4 Claims, 3 Drawing Sheets

INFANT TRAINING SHOES AND METHOD OF USING SAME

RELATED APPLICATIONS

The present application claims priority to U.S. Provisional Application Ser. No. 60/145,056, filed Jul. 22, 1999, for Infant Training Shoes.

FIELD OF INVENTION

The present invention relates to shoes for use in training an infant to walk and a method of training an infant to walk using such shoes.

BACKGROUND OF THE INVENTION

The majority of infants learn to walk at some time between the age of 9 and 17 months, with the average age being at about one year. It will be appreciated that this range of ages is not well-defined. Some infants learn to walk before the age of 9 months while others may not learn to walk by 17 months of age. Clearly, the range of ages at which infants learn to walk is quite broad.

Infants learn to walk largely by trial and error. In order to learn how to walk, infants must learn how to coordinate their muscles to support their weight and keep it balanced over their feet. Learning to walk can be a rather difficult endeavor for an infant regardless of the age at which they begin walking. Infants who are learning to walk tend to fall quite frequently, which can result in temporary pain, embarrassment, and/or a fear of falling. Frequent falling and lack of success can adversely affect an infant's confidence and determination, and can discourage the infant from continuing to try to learn to walk.

There is scant prior art addressing the difficulties encountered by infants as they learn to walk. McDermott, U.S. Pat. No. 2,724,193, discloses a walking aid for youngsters that comprises a platform or board that is strapped to the shoes or feet of a youngster. McDermott teaches that while the platforms may be likened to a sole, the invention resides primarily in their shape as shown in the figures accompanying the patent. When a platform according to McDermott is secured to a user's shoe or foot, it extends beyond the outer side of the user's foot to provide additional lateral support, but it does not extend beyond the toe, inside line, or heel of the user's foot.

Hirasawa et al., U.S. Pat. No. 3,728,803, discloses an infant shoe that include a 0.5 mm–1.0 mm thick board placed on the flat sole of the shoe so as to extend across the infant's heel to base of the fifth toe. Hirasawa et al. teaches that this board provides a rigid support over the full heel width and forward along the outer edge of the infant's foot. This board does not, however, extend beyond the periphery of the infants foot on any side, and thus does not provide any additional support beyond the conventional area of the sole.

SUMMARY OF INVENTION

The present invention provides a shoe for use in training an infant to walk. The shoe according to the present invention comprises an upper sized to receive an infant's foot, with the upper being attached to a sole. The sole extends a distance $D_1$ beyond a front side of the upper adjacent to the toes of the infant's foot, with the distance $D_1$ being defined as being from about 10% to about 30% of the length L of the infant's foot measured from heel to toe. Preferably, the sole also extends a distance $D_2$ beyond a rear side of the upper adjacent to the heel of the infant's foot, with the distance $D_2$ being defined as being from about 5% to about 15% of the length L. Preferably, the sole of the shoe also extends a distance $D_3$ beyond a first portion of an inner side of the upper adjacent to the ball of said infant's foot, with the distance $D_3$ defined as being up to about 30% of the width W of the infant's foot measured across the ball of the infant's foot. More preferably, the sole extends a distance $D_4$ beyond an outer side of the upper adjacent to the ball of the infant's foot, with the distance $D_4$ defined as being up to about 30% of the width W. The sole of the shoe according to the invention preferably has a smoothly blended arcuate perimeter.

The present invention also provides a method of training an infant to walk. The method according to the present invention comprises fitting a shoe on each foot of the infant, with each shoe including an upper sized to receive the infant's foot and a sole that is attached to the upper. The sole of each shoe extends a distance $D_1$ beyond a front side of the upper adjacent to the toes of the infant's foot, with the distance $D_1$ being from about 10% to about 30% of the length L of the infant's foot measured from heel to toe. The method further includes encouraging the infant to walk while wearing the shoes and removing a portion of the sole of each shoe so as to proportionally decrease the extent to which the sole extends beyond the upper as the infant learns to walk. Preferably, the sole of each shoe is provided with indicia that demarcates the amount of the sole that should be removed in order to proportionally decrease the extent to which the sole extends beyond the upper as the infant learns to walk.

The infant shoes according to the present invention are highly useful for training infants to walk. Infants wearing the shoes according to the invention have an easier time balancing their weight over their feet and have greater stability due to the "oversized" nature of the soles. Surprisingly, applicant has found that the portion of the sole extending beyond the front side of the upper adjacent to the infant's toes does not interfere with walking and does not cause infants to trip. Infants who learn to walk while wearing the shoes according to the invention fall less frequently and meet with greater success in a shorter period of time. By reducing the number of falls, infants quickly gain confidence and learn to walk much faster than without using the shoes. As the infant's confidence and walking ability improves, a proportional amount of the sole extending beyond the upper can be gradually removed in stages until the shoes have a "normal" appearance.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF PREFERRED EMBODIMENTS

The present invention was first disclosed in Fleshman, U.S. Provisional Application Ser. No. 60/145,056, filed Jul.

22, 1999, for Infant Training Shoes, which application is hereby incorporated by reference in its entirety.

Figure 1:
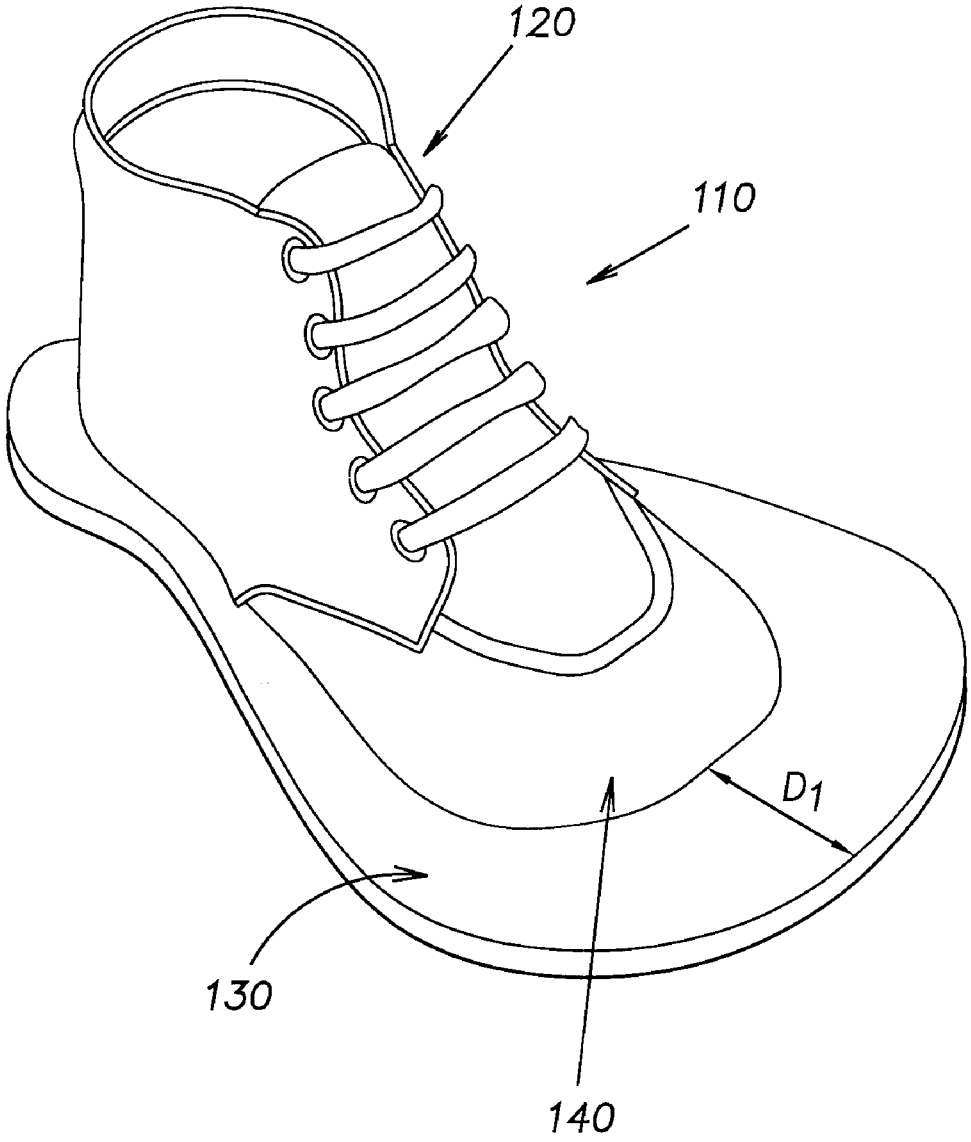
FIG. 1 is a perspective view of one preferred embodiment of a shoe according to the present invention.

With reference to FIG. 1, a shoe 110 for use in training an infant to walk according to the present invention comprises an upper 120 that is sized to receive an infant's foot. The upper 120 is attached to a sole 130. The sole 130 extends a distance $D_1$ beyond a front side 140 of the upper 120 adjacent to the toes of said infant's foot. Preferably, the sole 130 also extends a distance $D_2$ beyond a rear side 150 of the upper 120 adjacent to the heel of said infant's foot.

Figure 2:
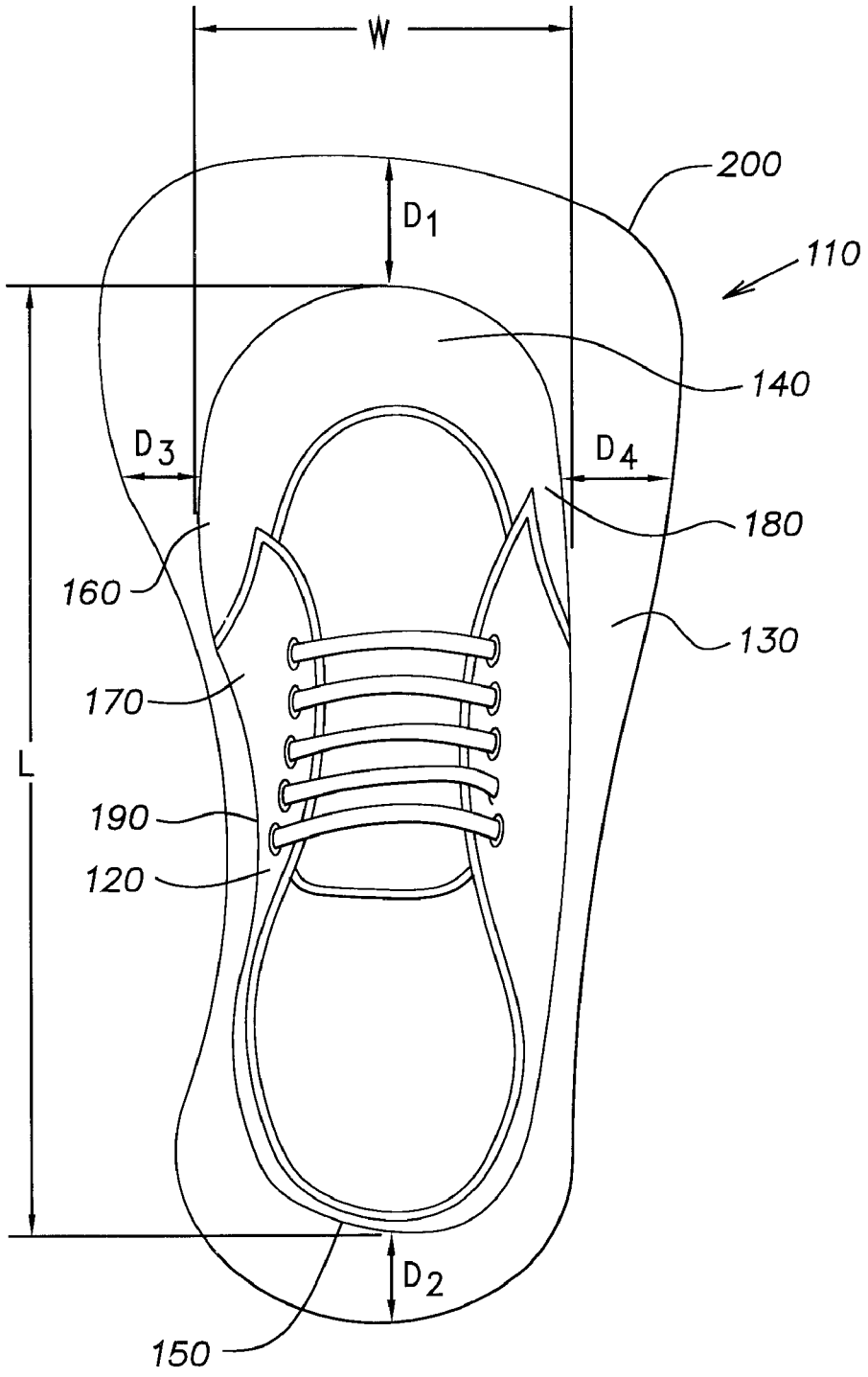
FIG. 2 is a top plan view of the shoe depicted in FIG. 1.

With reference to FIG. 2, the distance $D_1$ is defined as being from about 10% to about 30% of the length L of the infant's foot measured from heel to toe. The distance $D_2$ is defined as being from about 5% to about 15% of length L. The minimum distance $D_1$ at which an infant is assisted in maintaining his or her front balance is believed to be about 10% of length L. The maximum distance $D_1$ at which an infant is assisted in maintaining his or her front balance without interfering with normal walking is believed to be about 30% of length L. Similarly, the minimum distance $D_2$ at which an infant is assisted in maintaining his or her rear balance is believed to be about 5% of length L. And, the maximum distance $D_2$ at which an infant is assisted in maintaining his or her rear balance without interfering with normal walking is believed to be about 15% of length L. Preferably, the sole 130 extends a distance $D_3$ beyond a first portion 160 of an inner side 170 of the upper 120 adjacent to the ball of said infant's foot. The distance $D_3$ is defined as being up to about 30% of the width W of the infant's foot measured across the ball of the infant's foot. The sole 130 also preferably extends a distance $D_4$ beyond an outer side 180 of the upper 120 adjacent to the ball of the infant's foot. The distance $D_4$ is defined as being up to about 30% of width W. The minimum and maximum percentages given for distances $D_3$ and $D_4$ are believed to be the minimum and maximum distances at which an infant is assisted in maintaining his or her side-to-side balance without interfering with normal walking.

In the presently most preferred embodiment of the invention, the distance $D_1$ is about 20% of length L, the distance $D_2$ is about 10% of length L, and distances $D_3$ and $D_4$ are each about 20% of width W. In order to facilitate walking, preferably the sole 130 extends less than about 10% of width W beyond a second portion 190 of the inner side 170 of the upper 120 adjacent to the arch of the infant's foot. Also to facilitate walking, the sole 130 preferably has a smoothly blended arcuate perimeter 200 that does not have points or sharp edges that can catch on the walking surface.

Infants wearing the shoes according to the present invention tend to learn to walk over the course of a few weeks or less. During this time, the size of their feet usually does not change appreciably, which permits one pair of shoes to be used from the start to the end of training. It will be appreciated that the size of an infant's foot when he or she learns to walk will vary depending upon the age of the infant and other factors. Accordingly, a range of sizes of infant shoes according to the present invention are contemplated.

A typical length L of an infant's foot measured from heel to toe is about 11.5±2.0 cm, with the width W measured across the ball of the foot being 5.5±1.0 cm. Accordingly, the sole 130 typically extends a distance $D_1$ from about 1.25 cm to about 4.0 cm beyond a front side 140 of the upper 120 adjacent to the toes of the infant's foot. Similarly, the sole 130 typically extends a distance $D_2$ from about 0.6 cm to about 2.0 cm beyond a rear side 150 of the upper 120 adjacent to the heel of the infant's foot. In the preferred embodiment of the invention, the sole 130 typically extends a distance $D_3$ up to about 2.0 cm beyond the first portion 160 of the inner side 170 of the upper 120 adjacent to the ball of the infant's foot, and a distance $D_4$ up to about 2.0 cm beyond an outer side 180 of the upper 120 adjacent to the ball of the infant's foot. Preferably, the sole 130 extends less than about 0.6 cm beyond the second portion 190 of the inner side 170 of the upper 120 adjacent to the arch of the infant's foot. It will be appreciated that distances $D_1$, $D_2$, $D_3$, and $D_4$ will vary depending upon the size of the shoe.

The present invention also provides a novel method of training an infant to walk. The method according to the present invention comprises fitting a shoe according to the invention on each foot of the infant, encouraging the infant to walk while wearing the shoes, and removing a portion of the sole so as to proportionally decrease the extent to which the sole extends beyond the upper as the infant learns to walk. As the infant learns to walk, he or she will need less and less support beyond that which is provided by the sole of a conventional walking shoe. Thus, according to the method of the present invention, the amount of the sole extending beyond the upper is proportionally removed as the infant learns to walk until the shoe has the appearance of a conventional walking shoe.

Figure 3:
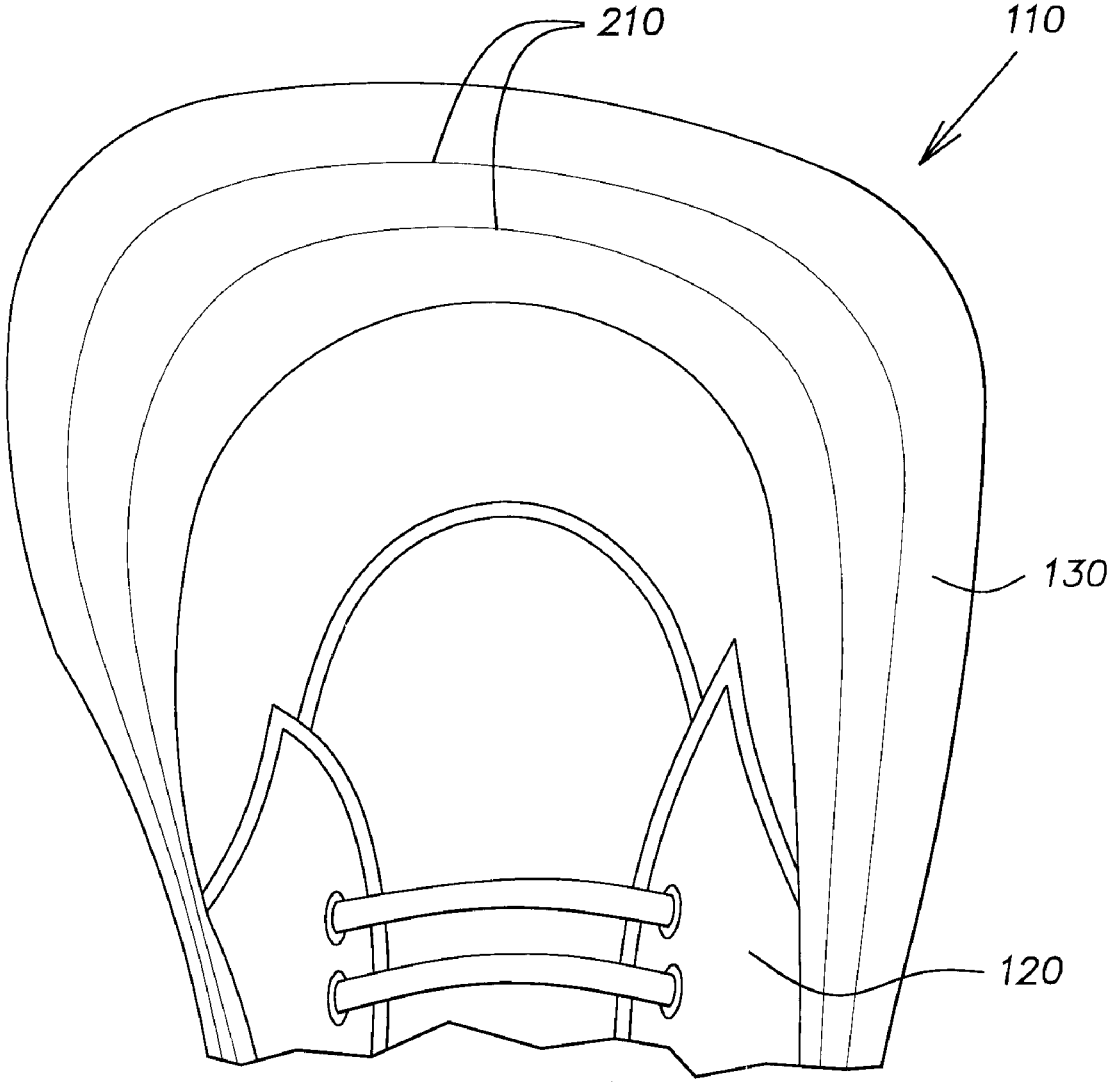
FIG. 3 is a top plan view of the front portion of the shoe depicted in FIG. 1.

With reference to FIG. 3, the sole 130 of the shoe 110 according to the invention is preferably provided with indicia 210 such as lines, ridges, or grooves that demarcate the amount of the sole 130 that should be removed in order to proportionally decrease the extent to which the sole 130 extends beyond the upper 120. It will be appreciated that the indicia 210 can be provided on the walking surface of the sole 130, the surface of the sole 130 that is attached to the upper 120, or on both of such surfaces. The number of indicia 210 such as lines is not per se critical, but usually 1 to 5 lines of indicia are sufficient.

The process by which the removal of the sole is accomplished will depend in large part upon the composition of the sole. Preferably, the sole is constructed of conventional shoe materials such as leather, particle board, or natural or synthetic polymers. A preferred method of removing the sole is by grinding using an abrasive wheel. The sole of the shoe can be pressed against a rotating abrasive wheel until the desired amount of the sole has been removed. Another suitable method of removing a portion of the sole is by cutting, which can be accomplished using shears or a press.

In another embodiment of the shoes according to the invention, the indicia for demarcating the amount of the sole that should be removed in order to proportionally decrease the extent to which the sole extends beyond the upper comprises grooves or recesses in the sole. Removal of a desired portion of the sole is accomplished simply by grasping the edge of the sole with a pair of pliers or other gripping tool and tearing away the desired portion of the sole, which will separate at the groove.

It will be appreciated that the configuration of the upper is not per se critical and that any of the many types of uppers can be used. For example, the upper could be in the form of a boot, a tennis shoe, or a sandal. Preferably, the upper is in the form of a boot or high-top tennis shoe that provides support for the infant's ankle as he or she learns to walk. The upper should secure the infant's foot to the sole. Slip-on type uppers are generally unsuited for use in the invention. The upper may be secured around the infant's foot using any of the known methods such as laces, straps, and/or Velcro™ hook and loop fasteners.

The sole of the shoe is preferably planar, but may include a slightly elevated heel portion. The bottom surface of the sole (i.e., the portion contacting the walking surface) is preferably smooth, but can be provided with any of the known features for improving traction and grip on a walking surface. The sole is preferably substantially rigid. The thickness of the sole is not per se critical, but is usually from about 0.5 cm to about 1.5 cm thick. It will be appreciated that the "oversized" sole according to the invention can be attached directly to the upper, or it can be attached to an intermediate sole that is of a conventional size relative to the upper.

The shoes and method according to the present invention permit infants to hold their balance for longer periods of time than when wearing conventional shoes. This increases the rate at which infants develop a sense of balance. It also has a positive effect on the infants' confidence and determination regarding the process of learning to walk. The "oversized" sole of the shoes according to the invention assist infants in regaining their balance as they weave and wobble on their feet in both the forward-backward and side-to-side directions. Infants learn to turn and bend while standing, and fall less frequently. The shoes and method generally instill confidence in infants, which assists them in acquiring walking skills more readily.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed:

1. A shoe for use in training an infant to walk comprising an upper sized to receive an infant's foot, said upper being attached to a sole, said sole extending from about 1.25 cm to about 4.0 cm beyond a front side of said upper adjacent to the toes of said infant's foot, said sole extending from about 0.6 cm to about 2.0 cm beyond a rear side of said upper adjacent to the heel of said infant's foot, said sole extending up to about 2.0 cm beyond a first portion of an inner side of said upper adjacent to the ball of said infant's foot, and said sole extending a distance less than about 0.6 cm beyond a second portion of an inner side of said upper adjacent to the arch of said infant's foot.

2. The shoe according to claim 1 wherein said sole extends up to about 2.0 cm beyond an outer side of said upper adjacent to the ball of said infant's foot.

3. The shoe according to claim 2 wherein said sole has a smoothly blended arcuate perimeter.

4. The shoe according to claim 2 wherein said sole is provided with Indicia that demarcates the amount of said sole that should be removed in order to proportionally decrease the extent to which said sole extends beyond said upper.

* * * * *